US006138851A

United States Patent [19]

Townson

[11] Patent Number: 6,138,851

[45] Date of Patent: Oct. 31, 2000

[54] CONTAINER

[75] Inventor: David John Townson, Walsall, United Kingdom

[73] Assignee: McKechnie UK Limited, West Midlands, United Kingdom

[21] Appl. No.: 09/167,062

[22] Filed: Oct. 6, 1998

[30] Foreign Application Priority Data

Oct. 7, 1997 [GB] United Kingdom ..... 9721129

[51] Int. Cl.[7] ..... B65D 6/18; B65D 88/52

[52] U.S. Cl. ..... 220/6; 220/1.5; 220/617; 220/691

[58] Field of Search ..... 220/6, 7, 4.28, 220/1.5, 682, 691, 621, 617; 217/65, 15, 47, 13, 43 R, 45

[56] References Cited

U.S. PATENT DOCUMENTS

| | | | |
|---|---|---|---|
| 2,291,888 | 8/1942 | Ericksen et al. | 220/7 |
| 4,591,065 | 5/1986 | Foy . | |
| 4,781,300 | 11/1988 | Long | 220/7 |
| 5,515,987 | 5/1996 | Jacques et al. | 220/6 |
| 5,632,392 | 5/1997 | Oh . | |
| 5,788,103 | 8/1998 | Wagner et al. | 220/6 |
| 5,853,099 | 12/1998 | Lessard | 220/7 |
| 5,938,059 | 8/1999 | Luburic | 220/7 |

FOREIGN PATENT DOCUMENTS 1 215 049 12/1970 United Kingdom .

*Primary Examiner*—Allan N. Shoap
*Assistant Examiner*—Niki M. Eloshway
*Attorney, Agent, or Firm*—Adams, Schwartz & Evans, P.A.

[57] ABSTRACT

A container 10 has a base 12 over which walls 14,16 can fold. Engaging castellations 20,24 are formed along the edges of the walls 14,16 to attach the walls together when the container is in the erect condition. The hinges 36 are arranged to accommodate the formations 20 when the container is collapsed. This allows a more compact folded condition to be achieved.

21 Claims, 13 Drawing Sheets

CONTAINER

TECHNICAL FIELD AND BACKGROUND OF THE INVENTION

The present invention relates to containers and in particular, to collapsible containers.

Collapsible containers allow the containers to be stored more compactly when not in use.

SUMMARY OF THE INVENTION

The invention provides a collapsible container comprising a base, a first wall hingedly attached to the base to fold down over the base when the container is collapsed and a second wall hingedly attached to the base to fold down over the first wall when the first wall is folded over the base, the adjacent edges of the first and second walls comprising engaging formations which engage when the container is in the constructed condition, and the hinge arrangement between the first wall and the base being arranged to accommodate the engaging formations of the second wall below the uppermost level of the first wall when the container is collapsed.

Preferably the engaging formations are intermeshable. The engaging formations of the second wall are preferably provided on a flange projecting from the face of the wall whereby, when the engaging formations are accommodated by the hinge arrangement, the wall face lies against or adjacent the upper face of the collapsed first wall.

The hinge arrangement between the first wall and the base preferably comprises interleaved knuckles, the knuckles being adapted to receive the engaging formations. The knuckles of the base are preferably adapted to receive the engaging formations. The knuckles may comprise recesses for receiving the engaging formations. Preferably the spacing of the knuckles corresponds with the spacing of the engaging formations, whereby each engaging formation is received in a corresponding knuckle. The knuckles are preferably regularly spaced. The engaging formations may be intermeshable castellations.

Preferably retaining means are associated with at least one wall, operable to retain that wall against folding down while another wall is moved up or down.

Preferably the walls are formed to co-operate as the first wall is raised to the erect position and after the second wall has been raised, the co-operation serving to push the second wall beyond the erect position to provide clearance for the first wall to reach the erect position, and thereafter to return to the erect position.

The engaging formations may comprise retention means operable to retain the castellations intermeshed. The retention means may comprise a projection on one wall, past which a part of the other wall must be forced to allow the first wall to reach or leave the erect position. The projection is preferably resilient. One or both walls may be deformable to allow the first wall to move. The projection is preferably carried by the second wall. The projection is preferably a rib extending along the second wall, preferably substantially parallel to the first wall when the first wall is in the erect position.

Preferably the container further comprises a lock arrangement carried by at least one wall and operable to lock an edge of the carrying wall to an adjacent wall when the walls are in their erect positions, and the lock means being manually releasable from a location remote from the said edge.

Preferably the container comprises two opposed first walls and two opposed second walls, both ends of the first and second walls being provided with engaging formations as aforesaid, and both first walls having hinge arrangements as aforesaid. The second walls may each carry a stacking bar which allows like containers to stack when in the constructed condition. The hinge axis of the or each second wall is preferably substantially at or above the plane of the upper surface of the first wall when collapsed.

In another aspect, the invention provides a collapsible container comprising a base, at least two walls hingedly attached to the base to fold down over the base when the container is collapsed, and retaining means associated with at least one wall and operable to retain that wall against folding down while another wall is moved up or down.

The said wall is preferably retained substantially in the erect position. The retaining means may be associated with the hinge connection to the base. The hinge arrangement preferably comprises interleaved knuckles on the wall and on the base, at least one knuckle having a projection which engages a part hinged thereto, to retain the said part against movement. The said part may comprise resilience by which the part may be forced past the projection. Preferably retaining means as aforesaid are associated with at least the first wall.

The invention provides a collapsible container comprising a base, the first wall hingedly attached to the base to fold down over the base when the container is collapsed, and the second wall hingedly attached to fold down over the first wall when the first wall is folded over the base, the walls being formed to co-operate as the first wall is raised to the erect position and after the second wall has been raised, the co-operation serving to push the second wall beyond the erect position to provide clearance for the first wall to reach the erect position, and thereafter to return to the erect position.

The co-operation may be provided by a projection on one wall, which engages the other wall as the walls move relative to each other. The projection is preferably provided on the second wall. The projection may engage the edge of the first wall. Preferably the projection comprises a leading edge and a slide face, the leading edge providing a cam action to push the second wall beyond the erect position as the edge of the first wall engages the leading edge, and the slide face providing a surface along which the edge of the first wall slides as the first wall moves to the erect position, the first wall moving clear of the projection as the first wall reaches the erect position, thereby allowing the second wall to move back to the erect position.

The invention also provides a collapsible container comprising a base, first opposed walls having an erect position and being hingedly attached to the base to fold down over the base when the container is collapsed, second opposed walls between the first opposed walls and having an erect position and being hingedly attached to the base to fold down over the first walls when the container is collapsed, the container further comprising a lock arrangement carried by at least one wall and operable to lock an edge of the carrying wall to an adjacent wall when the walls are in their erect positions, and the lock means being manually releasable from a location remote from the said edge.

The lock arrangement may comprise a locking bar retractable to release the adjacent wall. The locking bar is preferably resiliently biased to the advanced position. The lock arrangement may comprise a manually operable control member mechanically linked to retract the locking bar. The control member is preferably connected to one end of an elongate bowed member having a second end fixed in position, the locking bar being connected to the bowed member between the ends thereof, whereby the control member is moveable to cause the bowed member to change shape, preferably to straighten, and thereby to move the locking bar. Preferably the locking bar is connected to the bowed member through an intermediate portion hingedly connected to the locking bar and the bowed member. The control member is preferably located at a handle formation on the wall. Each second wall preferably carries lock means as aforesaid. The or each lock means may lock both edges of the carrying wall as aforesaid.

BRIEF DESCRIPTION OF THE DRAWINGS

An embodiment of the present invention will now be described in more detail, by way of example only, and with reference to the accompanying drawings, in which.

DESCRIPTION OF THE PREFERRED EMBODIMENT AND BEST MODE

Figure 1A:
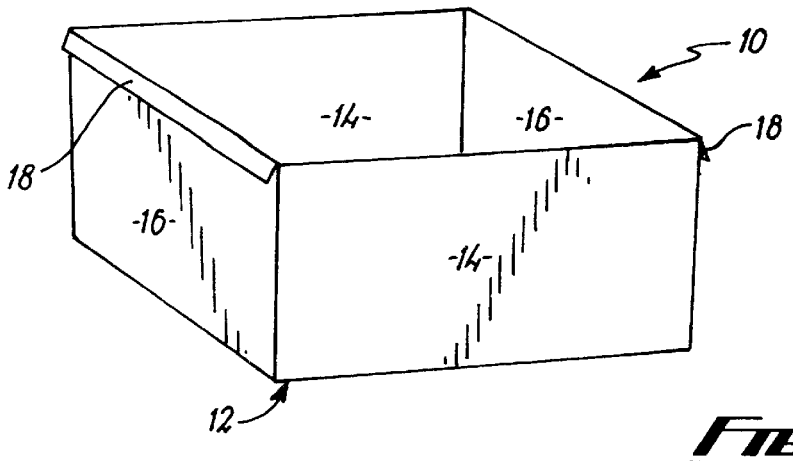
FIGS. 1*a,* 1*b,* 1*c* and 1*d* are a sequence of highly schematic perspective views of a container according to the invention in the process of being collapsed.
Figure 1B:
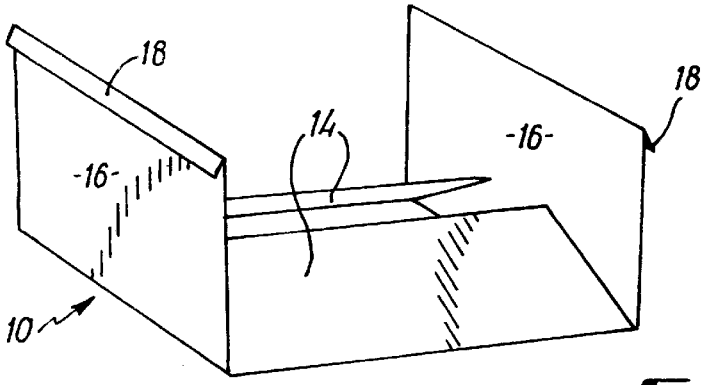
Figure 1C:
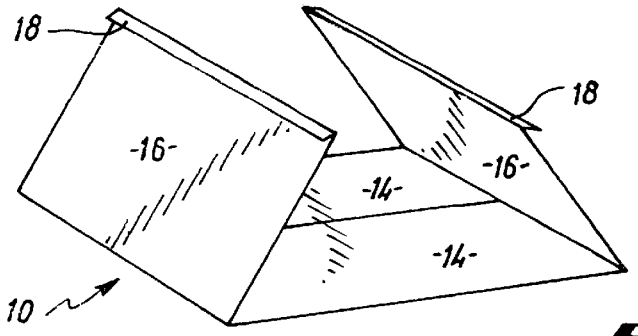

FIGS. 1*a* to 1*d* show a container 10 having a base 12, two relatively long first walls 14 and two relatively short second walls 16. (Alternatively, the walls 16 could be longer than the walls 14). The first walls 14 are hingedly attached along their lower edge to the base 12 to fold down over the base when the container is collapsed. FIG. 1*a* shows the fully constructed container and FIG. 1*b* shows its condition after this collapsing movement of the first walls has commenced. In FIG. 1*c,* the first walls 14 have fully collapsed over the base 12.

The second walls 16 are also hingedly attached to the base 12 to fold down over the first walls 14 once the first walls 14 have folded over the base 12. As can be seen, this collapsing movement commences in FIG. 1*c,* after the first walls 14 have fully collapsed. This results in the final condition shown in FIG. 1*d,* in which all four walls are lying over each other and the base, to leave a collapsed, flat container.

It is thus apparent that the "first" walls are the first to move when the container is collapsed.

If the container 10 is to be stackable or stable/nestable, a stacking bar 18 may be provided, preferably on the second walls 16 so that the bar 18 can remain mounted on the second wall 16 substantially without interfering with the collapsing process.

Other features of the invention, not shown in FIGS. 1*a* to 1*d* for reasons of clarity, can now be described in more detail.

Figure 2A:
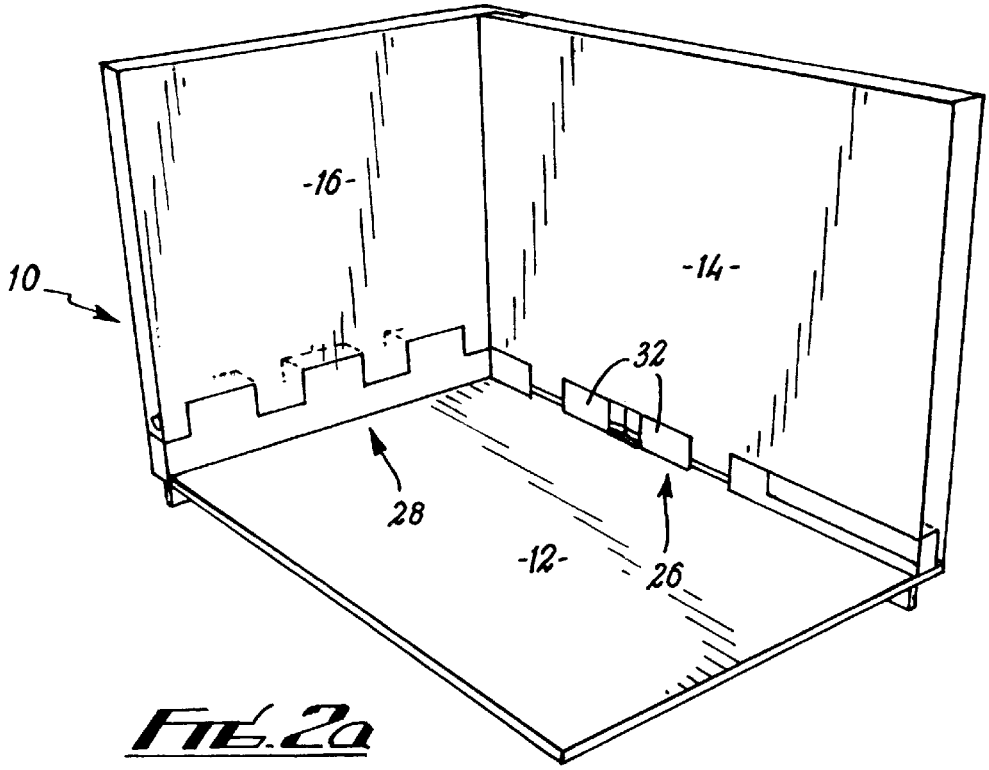
FIGS. 2*a* to 2*f* are schematic cut-away views into one corner of the container from within, showing a sequence as the container is collapsed.
Figure 2B:
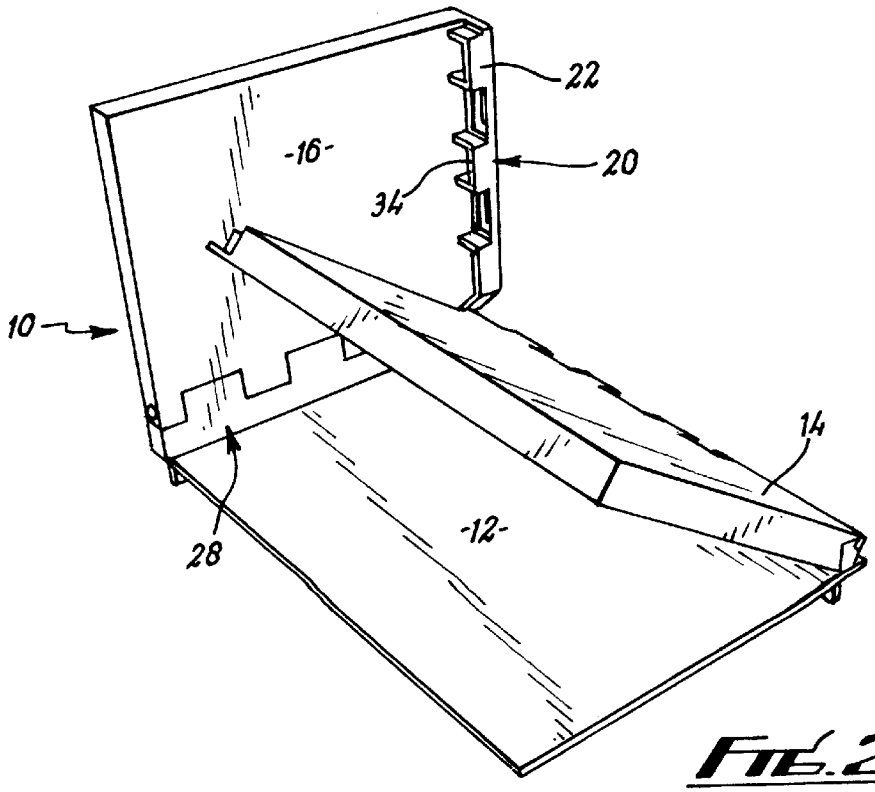

FIG. 2*a* views one corner of the container 10 in the constructed condition, i.e. before the walls have begun to collapse. In order to collapse the container, the first wall hinges in to the position shown in FIG. 2*b*. Before doing so, engagement between the adjacent edges of the walls 14, 16 must be released. The engaging formations on the wall 16 are visible in FIG. 2*b* as a vertical row of castellations 20 formed along a flange 22 which projects out of the plane of the wall 16, toward the wall 14. A complimentary line of castellations 24, visible for instance in FIG. 2*c,* is provided along the edge of the wall 14. The castellations 20, 24 engage each other, for instance by snap-fitting, when brought together in the constructed condition of the container 10, to hold the walls 14, 16 in that condition.

Figure 2C:
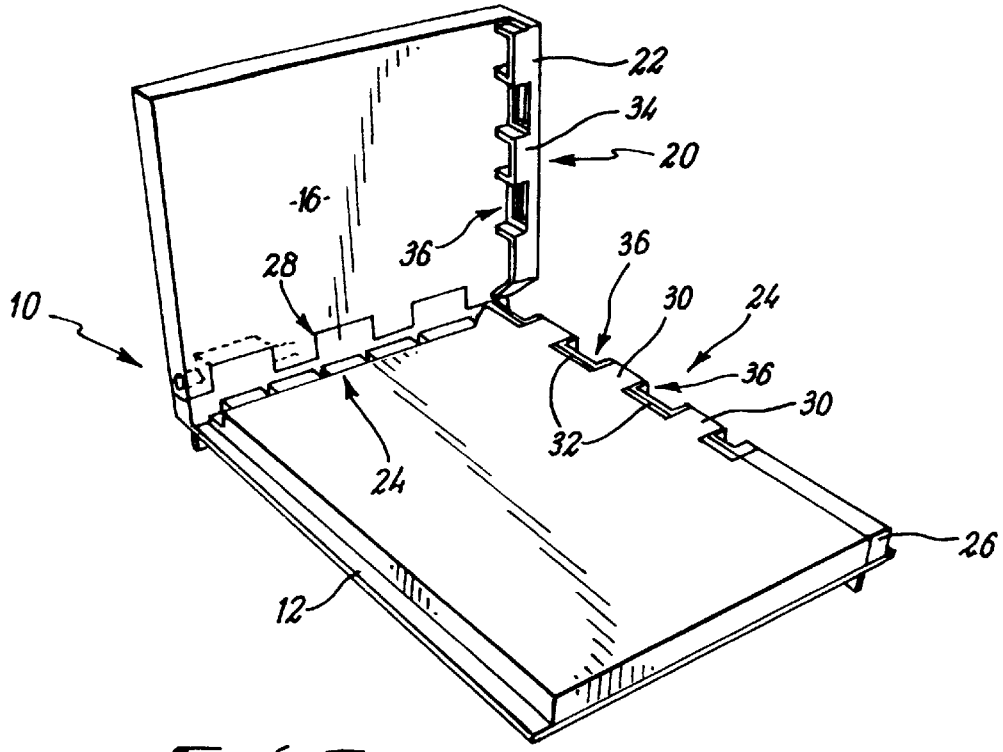

In the position illustrated in FIG. 2*c,* the wall 14 has reached its fully collapsed position, lying flat on the base 12. This is arranged by appropriate design of the hinge arrangement at 26, primarily by spacing the hinge axis above the base 12 by substantially one half of the thickness of the wall 14.

Figure 2D:
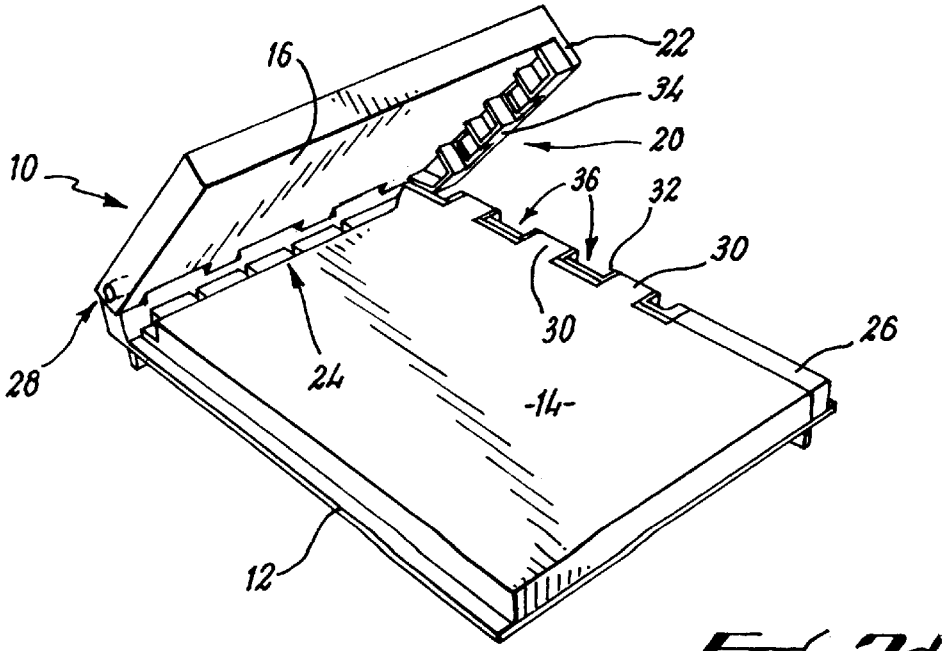
Figure 2E:
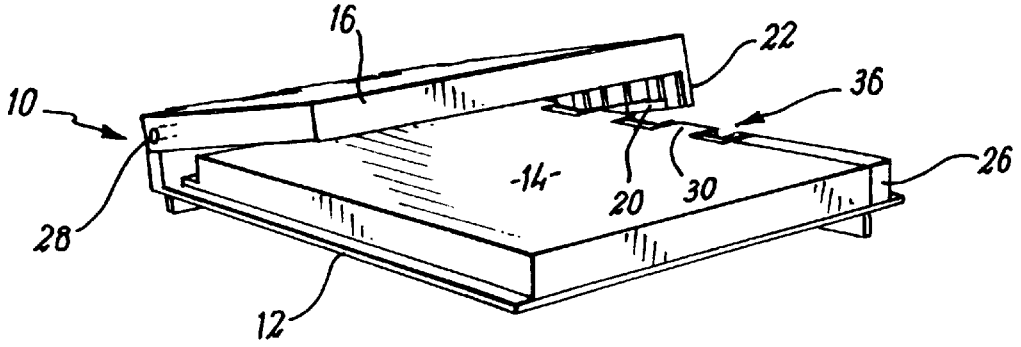
Figure 2F:
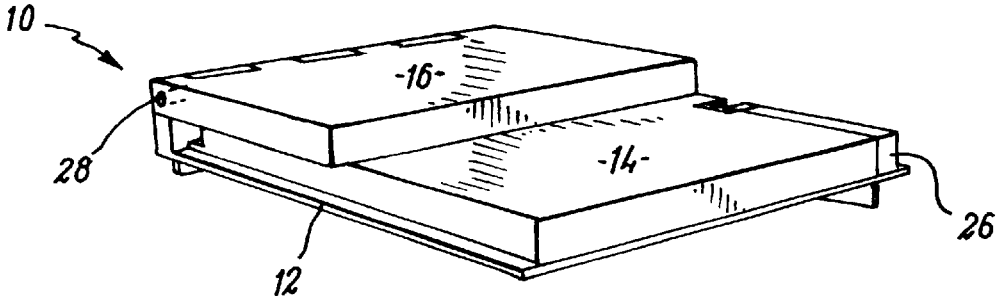

Once the position of FIG. 2*c* is reached, the second wall 16 can begin to collapse, folding down over the first wall 14 to an intermediate position shown in FIG. 2*d*. It can be seen from FIG. 2*d* that the axis of the hinge arrangement 28 for the second wall 16 is higher than that of the hinge arrangement 26. Preferably, the hinge axis of the hinge arrangement 28 is spaced above the upper surface of the wall 14 (when collapsed) by substantially one half of the thickness of the wall 16, so that the wall 16 can be folded down to lie flat against the exposed surface of the wall 14 when fully collapsed. FIG. 2*e* shows the wall 16 approaching that final position, which is shown in FIG. 2*f*.

The hinge arrangement 26 is visible in FIG. 2*d* and includes knuckles 30 along the bottom edge of the wall 14 and interleaved with knuckles 32 upstanding from the base 12. The knuckles 32 are hollow. They have recesses open from above. These recesses are positioned to achieve prominences 34 of the castellation 20 when the wall 16 fully collapses, at which position the knuckles 14 will be received in the recesses of the castellations 20. Consequently, the line of hinge knuckles 30, 32 intermesh with the castellation 20. By accommodating the castellations 20, this formation of the knuckles 32 ensures that the wall 16 can fold flat against the all 14, without needing to be spaced above it to accommodate the means for engagement between the walls when constructed. Moreover, it can be seen that because the formations of the castellations 20 and the formations of the hinge 16 are positioned to miss each other, they can each independently be optimised to their function of secure attachment and secure hinging, substantially without that process of optimisation affecting the corresponding process in relation to the other function.

Intermeshing of the castellations 20 and the knuckles 32 is most easily achieved by each being regularly spaced by the same spacing.

Figure 3A:
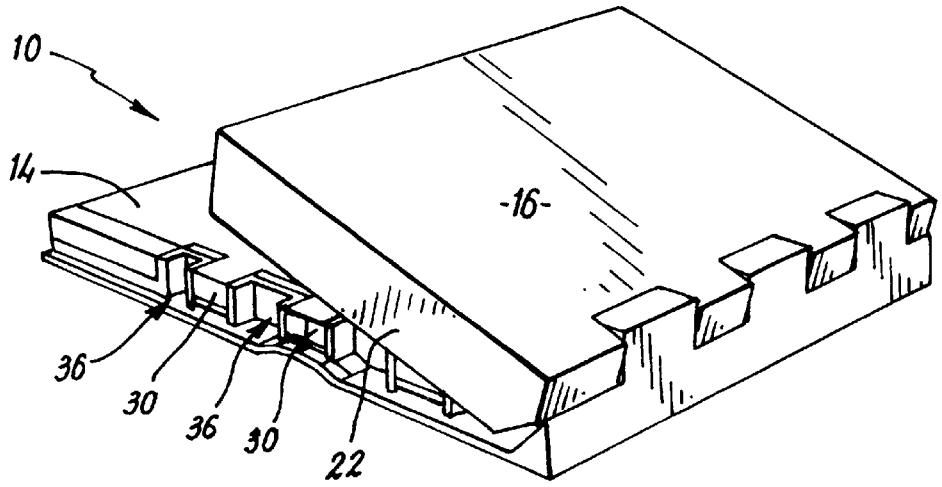
FIGS. 3*a* to 3*e* are a schematic sequence similar to FIGS. 2*a* to 2*f,* viewed from outside and showing the container being constructed.
Figure 3B:
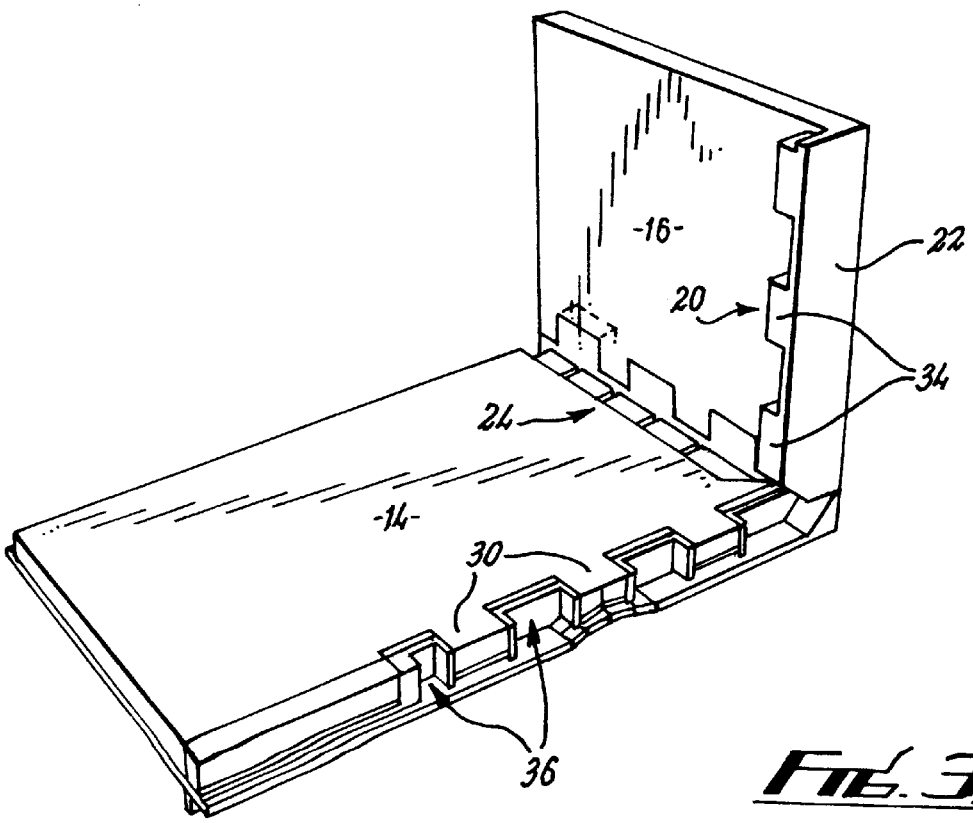
Figure 3C:
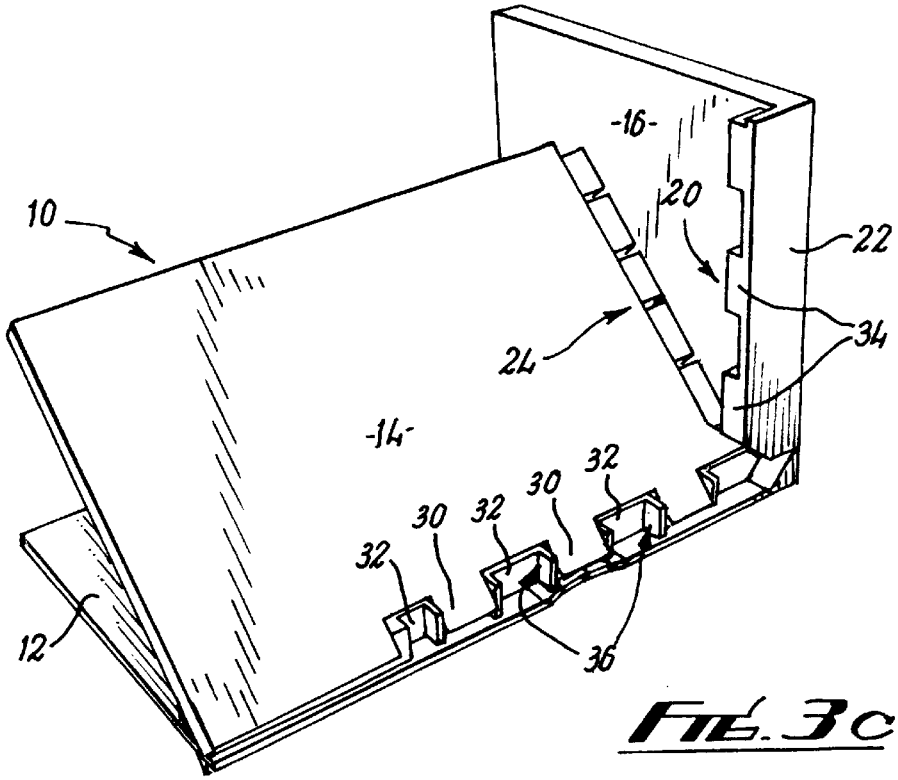
Figure 3D:
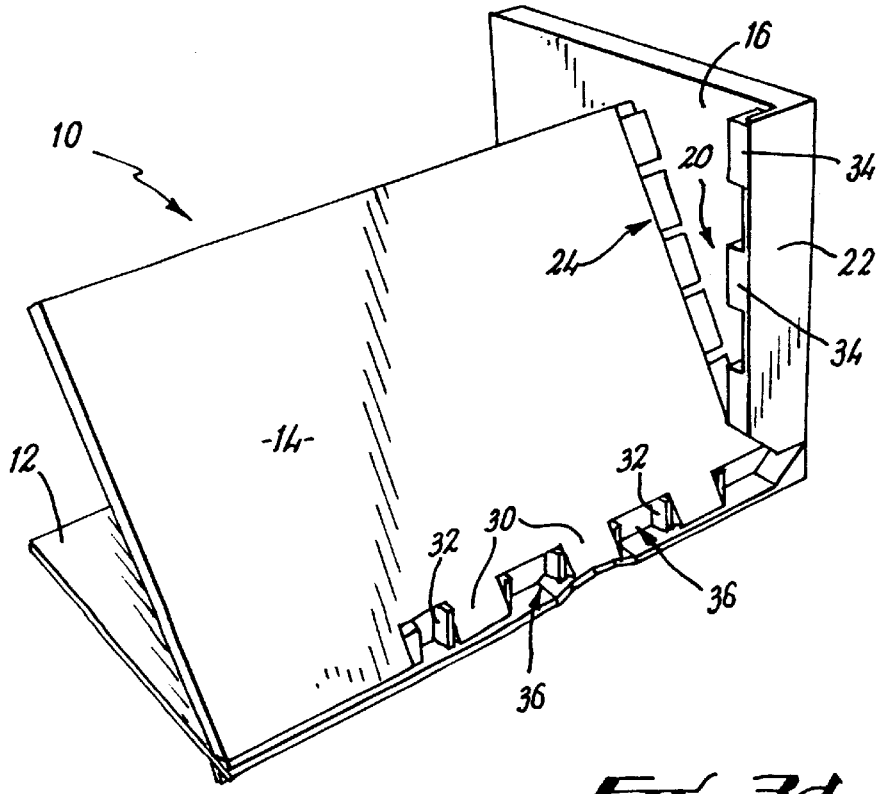
Figure 3E:
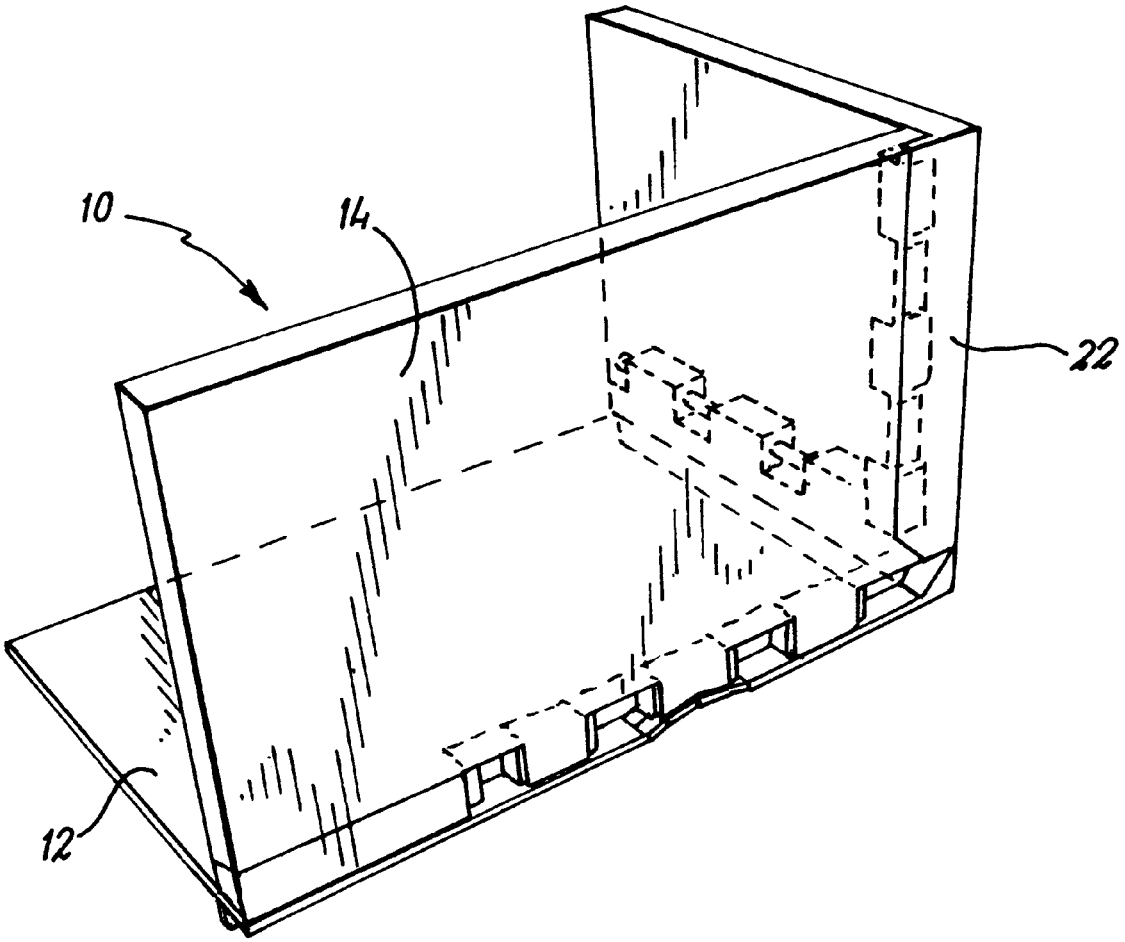

The remaining figures show the sequence by which the walls 14, 16 are moved from the collapsed position (FIG. 2*f*) to the constructed condition (FIG. 3*d*), when viewed from outside the container. Essentially, the sequence described above in relation to FIGS. 2*a* to 2*f* is reversed. First, the wall 16 is hinged up through the intermediate position of FIG. 3*a* to the vertical position of FIG. 3*b*. It can be seen in FIG. 3*b* that the castellations 20 have moved clear of the recesses 36 in the hinge 26, and are now exposed, ready to receive the castellations 24 when the wall 14 hinges up from the position shown in FIG. 3*b*, through the intermediate position shown in FIG. 3*c*, to the position shown in FIG. 3*d* at which the wall 14 is closely approaching its final position, illustrated in FIG. 3*e*. In the position of FIG. 3*e*, both walls 14, 16 have swung to their vertical position and the castellations 20, 24 have engaged, preferably by snap-fitting, to secure together the adjacent edges of the walls 14, 16 to produce a secure constructed container.

FIGS. 2 and 3 have shown only one corner of the container, for reasons of clarity of drawing and description. However, it will be readily apparent to the skilled man how the arrangement can be adapted to provide engaging formations of the same type at each corner of a container of the type illustrated in FIG. 1, so that in the constructed condition, the container is held securely at each of the four corners, while in the collapsed condition (FIG. 1*d*) the four sets of castellations 20 (one set at each end of each wall 16) are intermeshed with one or other hinge 16.

It may be necessary to provide curved surfaces on the castellations 20, and the recesses 36, both surfaces being centred on the axis of the hinge 28, to ensure that the intermeshing described can smoothly occur.

Figure 1D:
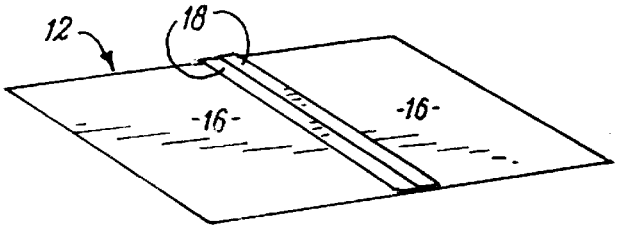

It can also be seen from FIG. 1*d* that the stacking bars 18 have not interfered with this collapsing and constructing operation.

Figure 4:
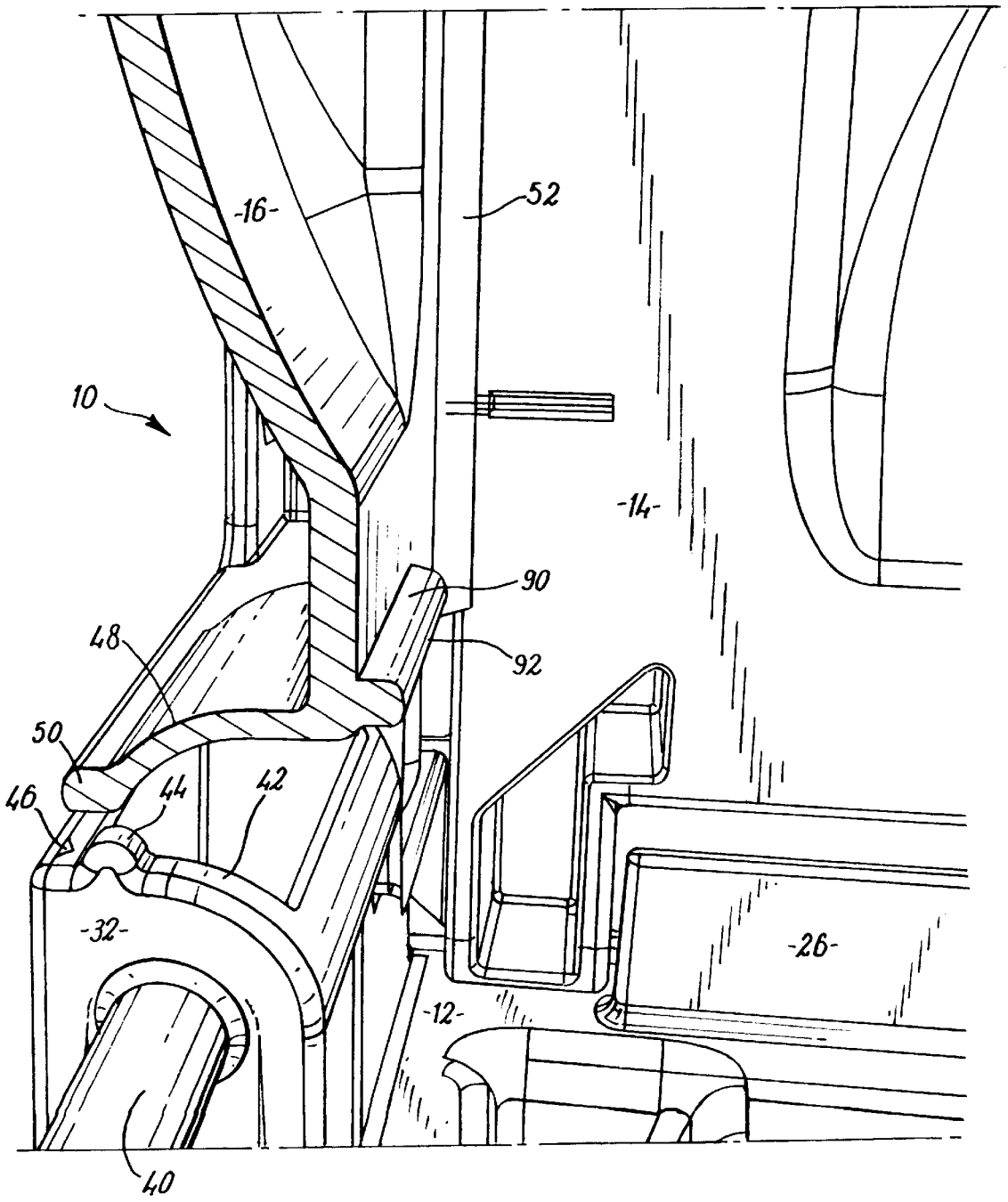
FIG. 4 is an enlarged, cut-away perspective view of a hinge arrangement of an alternative embodiment.

Various other modifications and alternative arrangements are shown in the remaining drawings. FIG. 4 shows a hinge arrangement, particularly for use along the lower edge of the second walls 16. The arrangements show in FIG. 4 correspond closely with the arrangements described above, but the embodiment shown in FIG. 4 is more highly styled for aesthetic and other reasons. However, the same numerals are used for corresponding items, when appropriate.

The base 12 of the container has upstanding knuckles 32, as has been described. Neighbouring knuckles 32 are connected by pivot pins 40 to allow intervening knuckles of the wall 16 to complete the hinge arrangement. The top edge 42 of the knuckles 32 has a curved shape centred on the pins 40, but interrupted by a projection 44 near the outer face of the knuckle 32 and which defines a small catch location 46 beyond the projection 44. The wall 16 carries along its lower edge a resilient valance 48 which, when the wall is in the erect condition shown in FIG. 4, covers the open top of the knuckles 32 and is generally complimentary in profile to the profile of the top edge 42. The outer edge of the valance 48 forms a bead 50 which can locate behind the projection 44, in the catch location 46 when the wall is in the erect position. The resilience of the valance 48 will tend to retain the bead 50 in the location 46, thus retaining the wall in the position shown. In particular, once the walls 16 have been raised to the erect position, prior to raising the walls 14, the bead 50 will slide along the edge 42 until encountering the projection 44, the valance 48 will flex to allow the bead 50 to pass over the projection 44, and the bead 50 will then snap down into the catch location 46, thereafter holding the wall 16 against falling back over the base 12. Once the walls 16 have snapped into position in this way, the user no longer needs to hold them up, allowing both hands then to be used to pull the walls 14 up to their erect position.

Figure 5:
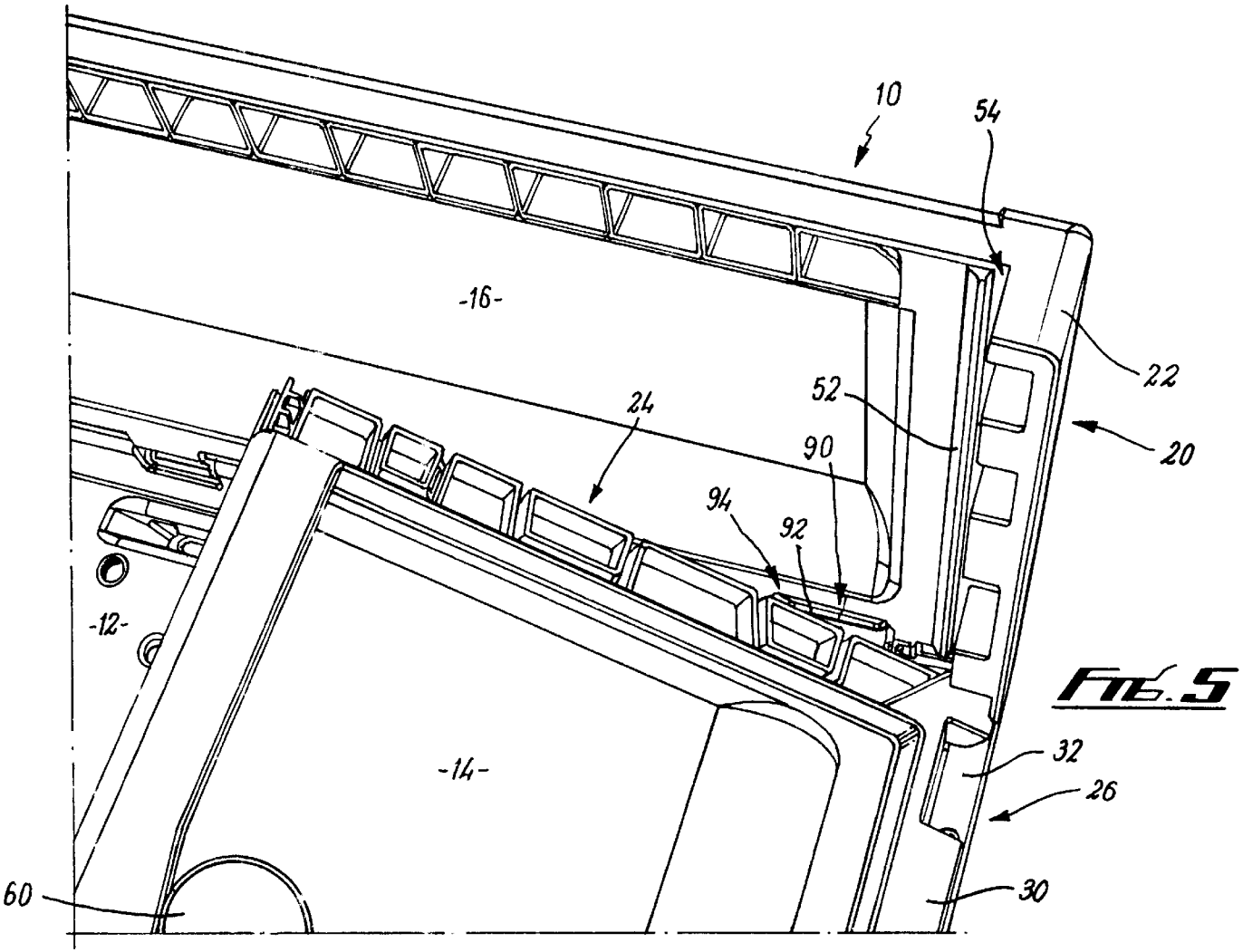
FIG. 5 corresponds generally with FIG. 2*b,* showing an alternative arrangement for retained walls in position.
Figure 6:
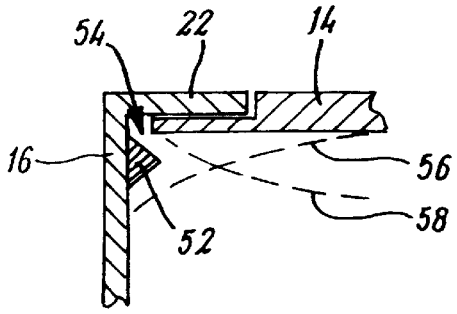
FIG. 6 is a highly schematic partial horizontal section through one corner of the container of FIG. 5.
Figure 7:
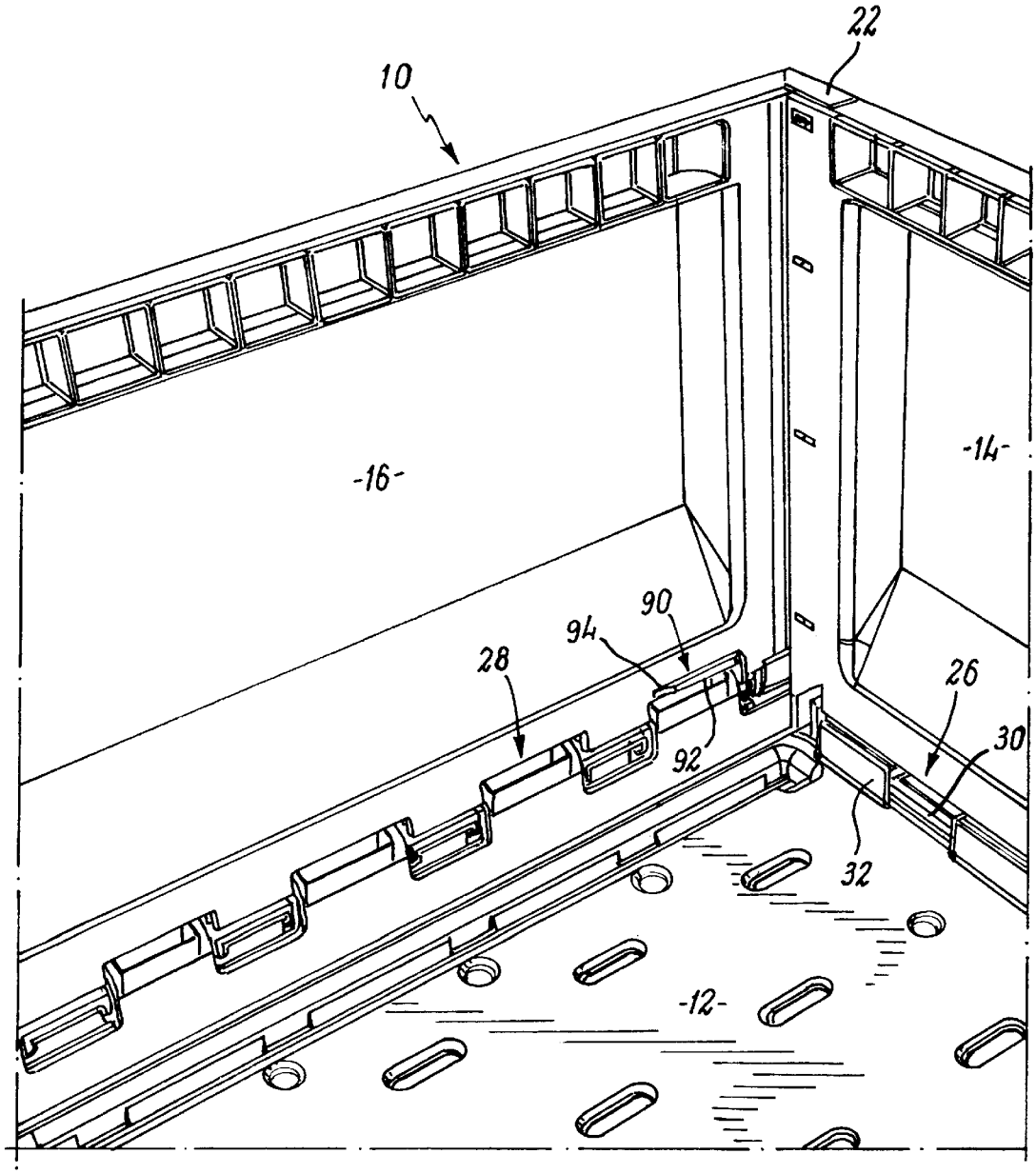
FIG. 7 is a partial enlarged perspective view corresponding generally with FIG. 2*a,* showing the alternative arrangement of FIGS. 5 and 6.

The walls 14 can be retained in their erect position in various ways, including snap-fitting as has been described. One example is illustrated in FIGS. 5 to 7. Again, like numerals have been used for corresponding features. In this arrangement, the wall 16 carries a rib 52 which (with the wall 16 in the erect condition) extends vertically up virtually the entire height of the wall 16, spaced slightly from the castellations 20 to define a vertical slot 54 therebetween (FIG. 6).

As the wall 14 approaches the erect position, the rib 52 represents an obstruction past which the edge of the wall 14 must move in order to reach the erect position, in which the edge of the wall 14 is located in the slot 54. The rib 52 may be made of resilient material, to allow the wall to be forced past, or there may be other resilience (as described below) which allows the wall 16 to be forced further out, past its erect position until the edge of the wall 14 has reached the slot 54, at which time the wall 16 can relax back to the erect position.

Alternatively, the wall 14 may move past the rib 52 by virtue of the wall 14 being deformed out of a planar condition, to a curved condition 56 illustrated in FIG. 6. As the middle of the wall 14 is pulled to the erect position, the edge encounters the ridge 52, is obstructed, and bows until being freed sufficiently to pass into the slot 54. The wall then straightens. In similar manner, the ribs 52 will retain the walls in the erect positions until the wall 14 is pushed or pulled inwardly sufficiently to curve to the position indicated at 58 in FIG. 6, at which the wall 14 has bowed sufficiently to free its edges from the slot 54, allowing the walls 14 to be folded down.

It is envisaged that by appropriate formation of the walls and ribs, this arrangement can be made to allow a wall 14 to be locked in the erect position more easily than it can be moved away from that position for collapsing the container.

Figure 8:
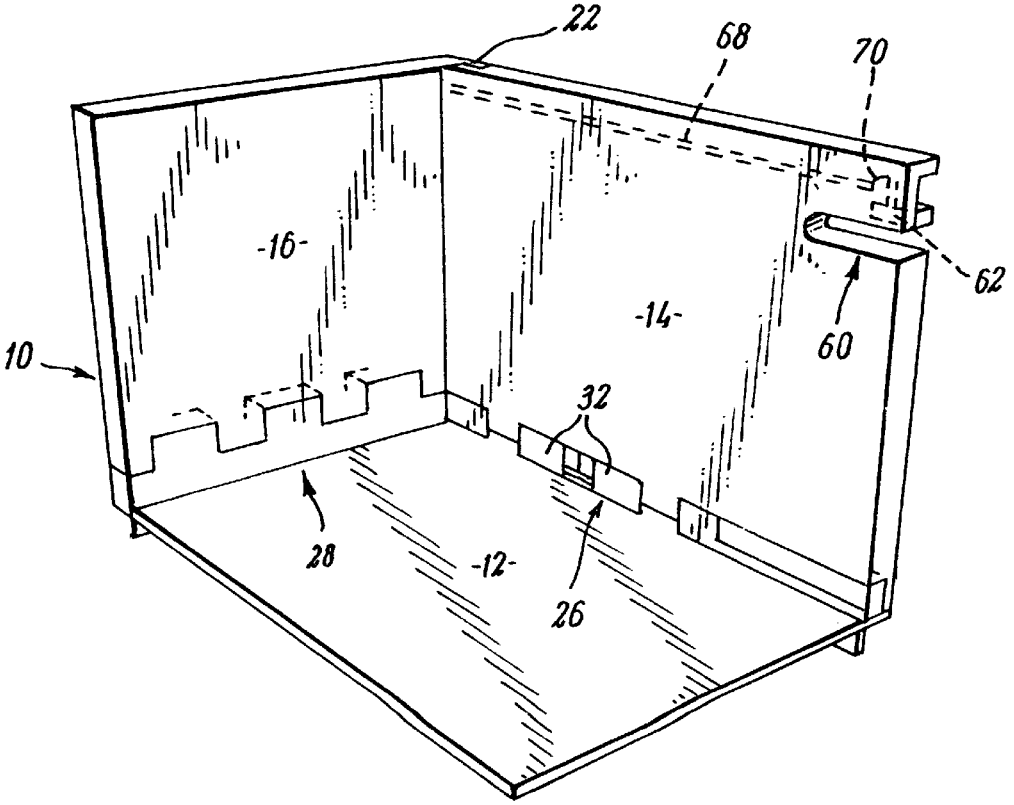
FIG. 8 corresponds generally with FIG. 2*a,* schematically illustrating a locking arrangement.
Figure 9:
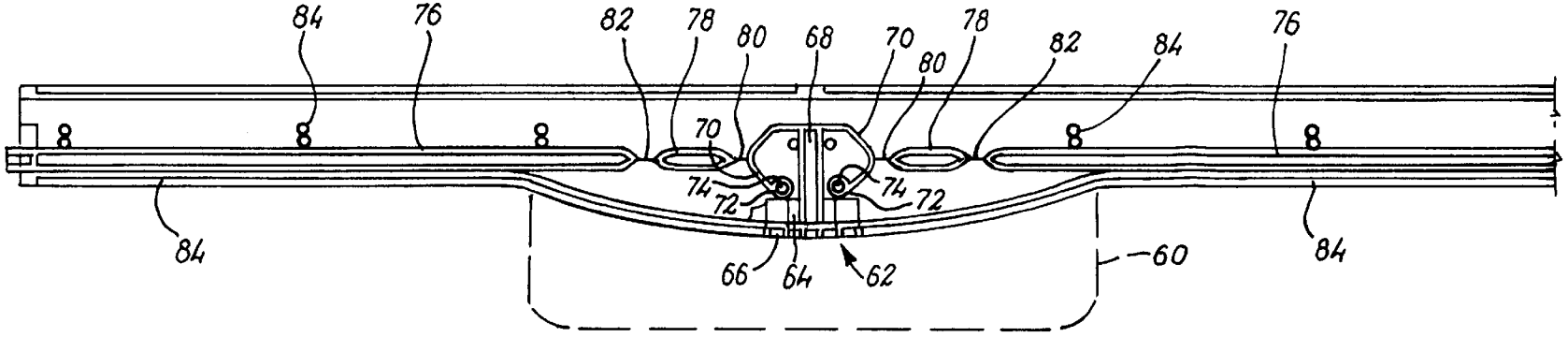
FIG. 9 shows the locking bar of the arrangement of FIG. 8.

Another alternative arrangement for locking the walls in the erect position is illustrated in FIGS. 8 and 9. FIG. 8 corresponds closely with FIG. 2*a*, and illustrates a handle 60 formed in the wall 14 as an aperture. A control member indicated schematically at 62 extends across the width of the wall 14, reaching both edges, and having a control button accessible to a users finger when the hand is in the handle aperture 60.

The control member 62 is illustrated in more detail in FIG. 9. The control button 64 has a finger pad 66 behind which a bar 68 extends. The remote end of the bar 68 is attached to one end of each of two bowed members 70, the other ends of which form eyes 72 located over pins 74 to fix those ends in position. Accordingly, pushing the button 64 to raise the bar 68 pushes the free ends of the members 70 away from the pins 74, causing the bowed members 70 to begin to straighten.

To each side of the bowed members 70, elongate locking bars 76 extend away to the edges of the walls 14. The ends of the bars 76 proximate the bowed members 70 are connected to a point midway along the corresponding member 70 through a short intermediate member 78 hinged at 80 to the bowed member 70, and at 82 to the locking bar 76. In consequence, pressing the button 64 causes the bowed members 70 to pull the locking bars 76 inboard of the wall 14, while releasing the button 64 allows the arrangement to relax, with the locking bars 76 projecting outboard of the walls 14. It is envisaged that the button 64, bar 68, members 70, 76 and 78 can be formed as a single plastics moulded item, having sufficient inherent resilience to bias the locking bars 76 to the locked position (shown in FIG. 9).

Movement of the locking bars 76 is axial, guided by guides, pins or other guide formations 84. These may be provided directly on the wall, or the complete latch arrangement could be a sub-assembly for attachment to the wall 14.

Figure 10:
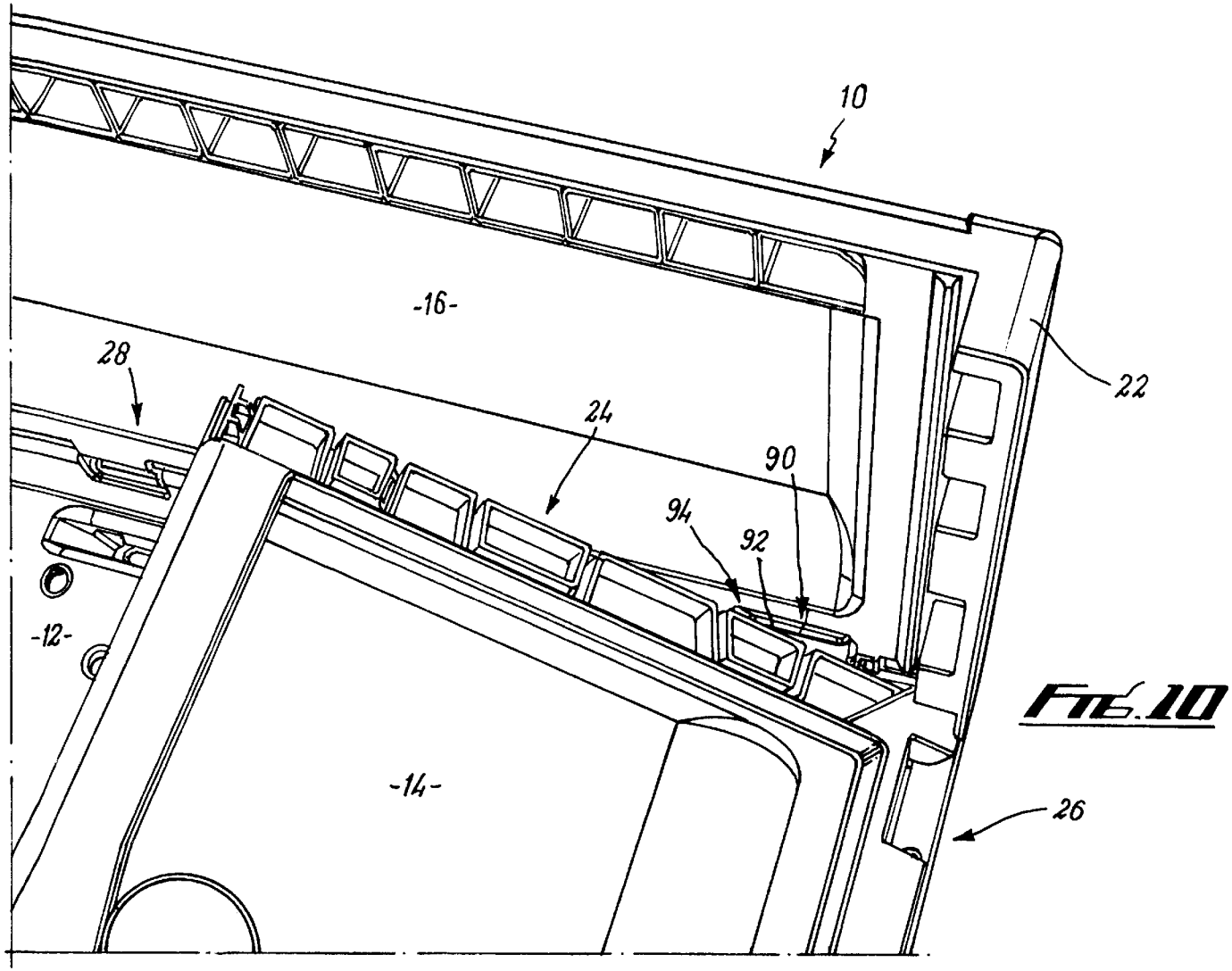
FIG. 10 is a perspective view of one corner of the container of FIG. 4.

Referring now to FIG. 10, a further feature of the walls 16 can be described. A short rib 90 is provided on the wall 16, near the corner of the container and close to the hinges. The rib 90 is shown in FIG. 10 and also partially in FIG. 4. The rib 90 is generally elongate, having a slide surface 92 along almost the whole of its length, preceded by a sloping leading edge at the end remote from the corner of the container. The purpose of the rib 90 is to engage the edge of the wall 14 as the wall 14 moves past the rib 90 to approach its erect position. As the wall 14 moves, its outer most edge encounters first the leading edge 94 of the rib 90, which creates a camming action as the wall continues to move, by which the wall 16 is forced out beyond the erect position. This may be against resilience provided either by the valance 48 or otherwise. As the edge of the wall 14 reaches the side surface 92, the position of the wall 16 is maintained as the wall 14 slides further towards its erect position. As the edge of the wall 14 moves past the rib 90, the wall 16 is then freed to relax back to its erect position. This arrangement ensures that the upper corner of the wall 14 does not catch against any formations on the wall 16 (particularly along its upper edge) by providing clearance while the rib 90 is active, but ensures that the wall 16 is in the final erect position just as the wall 14 reaches its erect position, so that the various castellations described above can correctly locate with each other.

Many variations and modifications can be made to the apparatus described above, without departing from the scope of the invention. In particular, many other forms of engaging formation could be devised for engagement between the edges of adjacent walls, and other formations of hinge could be designed to accommodate any such changes. Many of the features described above in relation to various embodiments can be used in various combinations with each other, including combinations not specifically described. The container can preferably be manufactured from synthetic plastics material, preferably by injection moulding.

Whilst endeavouring in the foregoing specification to draw attention to those features of the invention believed to be of particular importance it should be understood that the Applicant claims protection in respect of any patentable feature of combination of features hereinbefore referred to and/or shown in the drawings whether or not particular emphasis has been placed thereon.

What is claimed is:

1. A collapsible container comprising a base, a first wall hingedly attached to the base to fold down over the base when the container is collapsed and a second wall hingedly attached to the base to fold down over the first wall when the first wall is folded over the base, adjacent edges of the first and second walls comprising engaging formations which engage when the container is in a constructed condition, and a hinge arrangement between the first wall and the base comprises interleaved knuckles adapted to receive the engaging formations of the second wall to accommodate the engaging formations below an uppermost level of the first wall when the container is collapsed.

2. The container of claim 1, wherein the engaging formations are intermeshable.

3. The container of claim 1, wherein the engaging formations of the second wall are provided on a flange projecting from the face of the wall whereby, when the engaging formations are accommodated by the hinge arrangement, the wall face lies against or adjacent the upper face of the collapsed first wall.

4. The container of claim 1, wherein the knuckles of the base are adapted to receive the engaging formations.

5. The container of claim 1, wherein the knuckles comprise recesses for receiving the engaging formations.

6. The container of claim 1, wherein the spacing of the knuckles corresponds with the spacing of the engaging formations, whereby each engaging formation is received in a corresponding knuckle.

7. The container of claim 1, wherein the knuckles are regularly spaced.

8. The container of claim 1, wherein the engaging formations are intermeshable castellations.

9. The container of claim 8, wherein the engaging formations comprise retention means operable to retain the castellations intermeshed.

10. The container of claim 9, wherein the retention means comprise a projection on one wall, past which a part of the other wall must be forced to allow the first wall to reach or leave the erect position.

11. The container of claim 10, wherein the projection is resilient.

12. The container of claim 10, wherein one or both walls is deformable to allow the first wall to move.

13. The container of claim 10, wherein the projection is carried by the second wall.

14. The container of claim 10, wherein the projection is a rib extending along the second wall.

15. The container of claim 14, wherein the rib extends substantially parallel to the first wall when the first wall is in the erect position.

16. The container of claim 1, wherein retaining means are associated with at least one wall, operable to retain that wall against folding down while another wall is moved up or down.

17. The container of claim 1, wherein the walls are formed to co-operate as the first wall is raised to the erect position and after the second wall has been raised, the co-operation serving to push the second wall beyond the erect position to provide clearance for the first wall to reach the erect position, and thereafter to return to the erect position.

18. The container of claim 1, further comprising a lock arrangement carried by at least one wall and operable to lock an edge of the carrying wall to an adjacent wall when the walls are in their erect positions, and the lock means being manually releasable from a location remote from the said edge.

19. The container of claim 1, comprising two opposed first walls and two opposed second walls, both ends of the first and second walls being provided with engaging formations as aforesaid, and both first walls having hinge arrangements as aforesaid.

20. The container of claim 19, wherein the second walls each carry a stacking bar which allows like containers to stack when in the constructed condition.

21. The container of claim 1, wherein the hinge axis of the second wall is substantially at or above the plane of the upper surface of the first wall when collapsed.

* * * * *